US007404744B2

(12) United States Patent
Amano et al.

(10) Patent No.: US 7,404,744 B2
(45) Date of Patent: Jul. 29, 2008

(54) CONNECTOR AND A CONNECTOR ASSEMBLY

(75) Inventors: Takamaru Amano, Yokkaichi (JP); Ryotaro Ishikawa, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/699,968

(22) Filed: Jan. 30, 2007

(65) Prior Publication Data

US 2007/0178765 A1 Aug. 2, 2007

(30) Foreign Application Priority Data

Feb. 1, 2006 (JP) ..... 2006-024672

(51) Int. Cl.
*H01R 13/502* (2006.01)

(52) U.S. Cl. ..... 439/701; 439/540.1; 439/541.5

(58) Field of Classification Search ..... 439/540.1, 439/541.5, 701
See application file for complete search history.

(56) References Cited

U.S. PATENT DOCUMENTS 5,904,598 A * 5/1999 Yamanashi ..... 439/701
6,120,332 A 9/2000 Bertens et al.
6,129,593 A 10/2000 Aoyama et al.
6,179,653 B1 * 1/2001 Cheng et al. ..... 439/541.5
6,193,550 B1 2/2001 Yamashita et al.
7,316,582 B2 * 1/2008 Fan ..... 439/540.1
2002/0052152 A1 5/2002 Sakurai et al.

FOREIGN PATENT DOCUMENTS

JP 10-106670 4/1998

* cited by examiner

*Primary Examiner*—Truc Nguyen
(74) *Attorney, Agent, or Firm*—Gerald E. Hespos; Anthony J. Casella

(57) ABSTRACT

A female housing (10) is divided into a first and a second blocks (15A, 15B) that can be united by fitting a rib (27) of the second block (15B) into a dovetail groove (19) of the first block (15A). With the two blocks (15A, 15B) united, tab-shaped terminal insertion passages (29) are formed up to the dovetail groove (19) and the rib (27) in the female housing (10). This enables male tabs (13) to enter the tab-shaped terminal insertion passages (29) and prevents them from interfering with the female housing (10), wherefore a male housing (11) can be used commonly for a unitary female housing (40) and the divided female housing (10).

11 Claims, 11 Drawing Sheets

CONNECTOR AND A CONNECTOR ASSEMBLY

BACKGROUND OF THE INVENTION

1. Field of the Invention

The invention relates to a connector and a connector assembly.

2. Description of the Related Art

A known connector has first and second housings that are connectable with each other. Cavities are formed in the first housing and terminal fittings are accommodated in the cavities. Tab-shaped terminals are arranged in the second housing. The tabs enter the cavities and electrically contact the terminal fittings when the two housings are connected. At least one of the housings of the connector often is formed unitarily as a single member.

A connector of an automotive wiring harness may connect several different circuits to one circuit. In such a case, plural circuits are wired in a single housing. A wiring operation is cumbersome in this situation because wires in the one housing are likely to be of different lengths and are likely to be laid along different paths. A divided connector addresses these problems by effectively dividing the housing into plural blocks. Wire laying operations then can be performed efficiently and independently for the circuits in the respective blocks. A connector of this type is e.g. known from Japanese Unexamined Patent Publication No. H10-106670.

Outer surfaces of each block-shaped housing of a divided connector are formed with dovetail grooves or ribs. The dovetail grooves and ribs of adjacent block-shaped housings of the divided connector are engaged with one another to prevent the block-shaped housings from separating during the connecting operation of two connector housings. Thus, an operator need not press the blocks together while performing a connecting operation, and operation efficiency can be improved.

Each housing of the above-described divided connector is formed with cavities for receiving terminal fittings. The leading ends of the tab-shaped terminals would interfere with a connecting surface of a mating housing during a connecting operation if the cavities for the tab shaped terminals were arranged at positions corresponding to the dovetail grooves or ribs on the mating housing. Thus, the tab-shaped terminals cannot be arranged at positions that will align with the dovetail grooves or ribs on the mating housing. Then, the mating housing only can be used exclusively for the one divided housing and cannot be used for a unitary housing.

The invention was developed in view of the above situation, and an object thereof is to provide a connector and a connector assembly in which the other connector housing can be commonly used for one unitary-type connector housing and one divided-type connector housing.

SUMMARY OF THE INVENTION

The invention relates to a connector with a housing that is connectable with a mating housing along a connecting direction. The housing comprises blocks arranged in a direction intersecting the connecting direction. Each block is formed with cavities for accommodating at least one terminal fitting. Each block has at least one engaging portion that is engageable with the engaging portion on at least one adjacent block for holding the blocks together. Thus, the housing can be connected with the mating housing while the blocks are connected. At least one tab insertion passage extending back substantially in the connecting direction from a connecting surface of the housing with the mating housing and is formed up to the engaging portion in the housing along boundary surfaces of the respective blocks when the blocks are connected. The leading end of a tab-shaped terminal of the mating housing does not interfere with the back wall of the tab insertion passage when the housing is connected properly with the mating housing.

Accordingly, the tab terminals in the cavities can enter the cavities of the mating housing and can connect with the respective mating terminal fittings. On the other hand, the terminal fitting arranged at a position corresponding to the engaging portion enters the tab insertion passage that extends substantially to the engaging portion. The back wall of the tab insertion passage and the leading end of the tab-shaped terminal do not interfere with each other when the two housings are connected properly. Thus, the two housings are properly connectable even though the one housing is divided.

As described above, the tab terminal can be provided in the mating housing at the position corresponding to the engaging portion even if the housing is divided, and the mating housing can be used commonly regardless of whether the housing is unitary or divided.

The engaging portion preferably comprises a dovetail groove extending at an angle, and preferably a right angle, to the connecting direction, and the interacting portion preferably comprises a rib that fits into the groove. Thus, the blocks will not displace along the connecting direction of the housing even if the other housing contacts the housing from the front.

At least one groove-side tab insertion passage preferably is formed in at least one block and communicates with the respective dovetail groove and at least one rib-side tab insertion passage is formed in the other block. The groove-side tab insertion passage and the rib-side tab insertion passage preferably communicate with each other to form at least part of the tab insertion passage by uniting the respective blocks.

The groove-side tab insertion passage and the rib-side tab insertion passage will not align if the blocks are united while being displaced from each other. As a result, part of the inner wall of the tab insertion passage may project inward, and the tab may interfere with the inward projecting part of the inner wall of the tab insertion passage if an attempt is made to connect the housing with the mating housing in this disposition.

Accordingly, the blocks of the subject invention preferably have positioning means for aligning the dovetail-groove side tab insertion passage and the rib side tab insertion passage. Therefore, the tab-shaped terminal will not interfere with the inner wall of the tab insertion passage.

The blocks preferably can be united substantially along a mating direction by sliding one block relative to the other block to fit the ribs into the dovetail grooves.

One of the engaging portion and the interacting portion preferably has a locking claw and the other preferably has a receiving portion for resiliently engaging the locking claw.

The invention also relates to a connector assembly comprising the above-described housing and a mating housing. The housing preferably has terminal fittings, and the mating housing has a plurality of tab-shaped terminals to be connected with the terminal fittings.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector according to the invention includes female and male housings identified generally by the numerals 10 and 11 respectively in FIGS. 1 to 12. The housings 10 and 11 are connectable with each other along a connecting direction CD.

Figure 10:
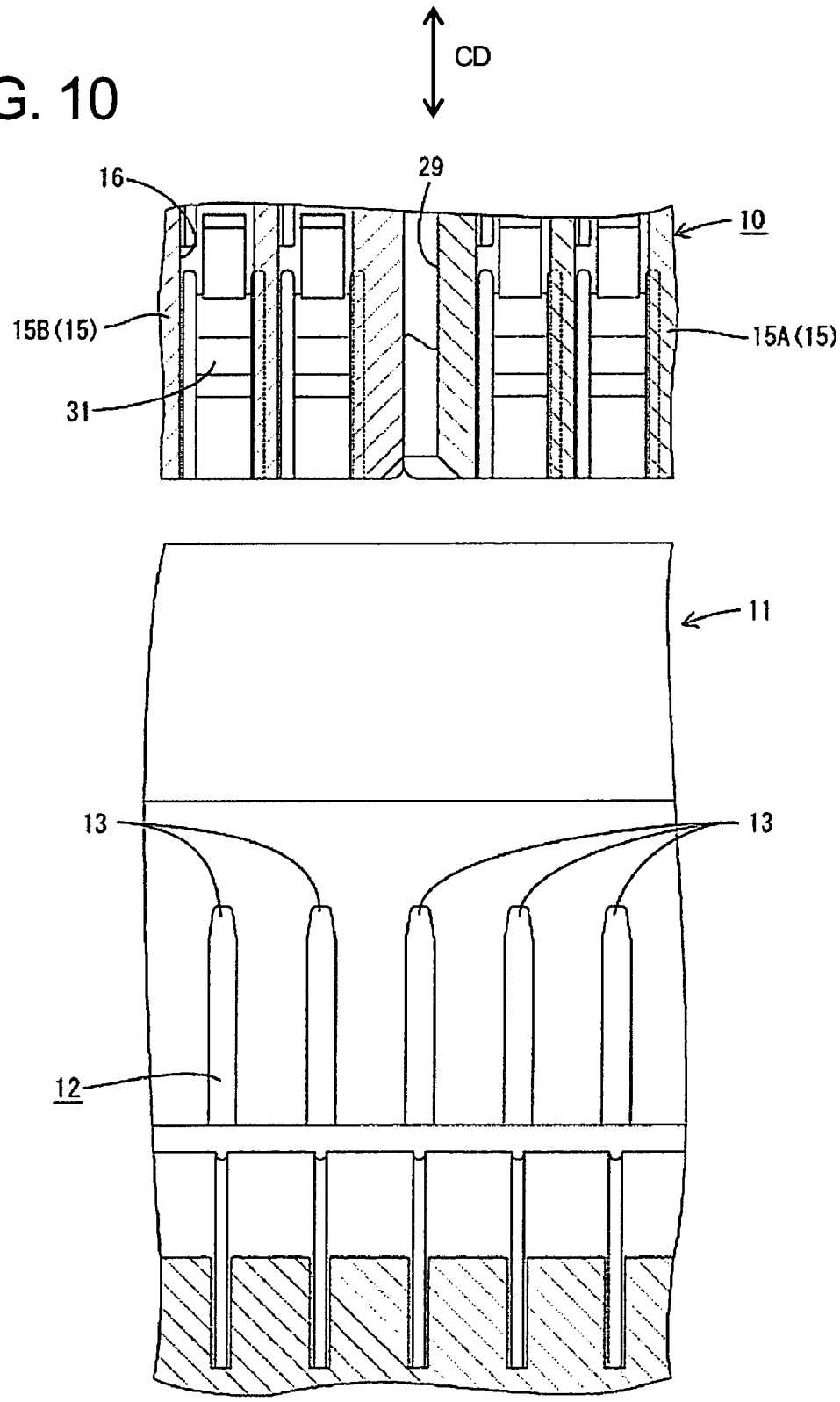
FIG. 10 is a partial enlarged section showing a state before a male housing and the female housing are connected.
Figure 11:
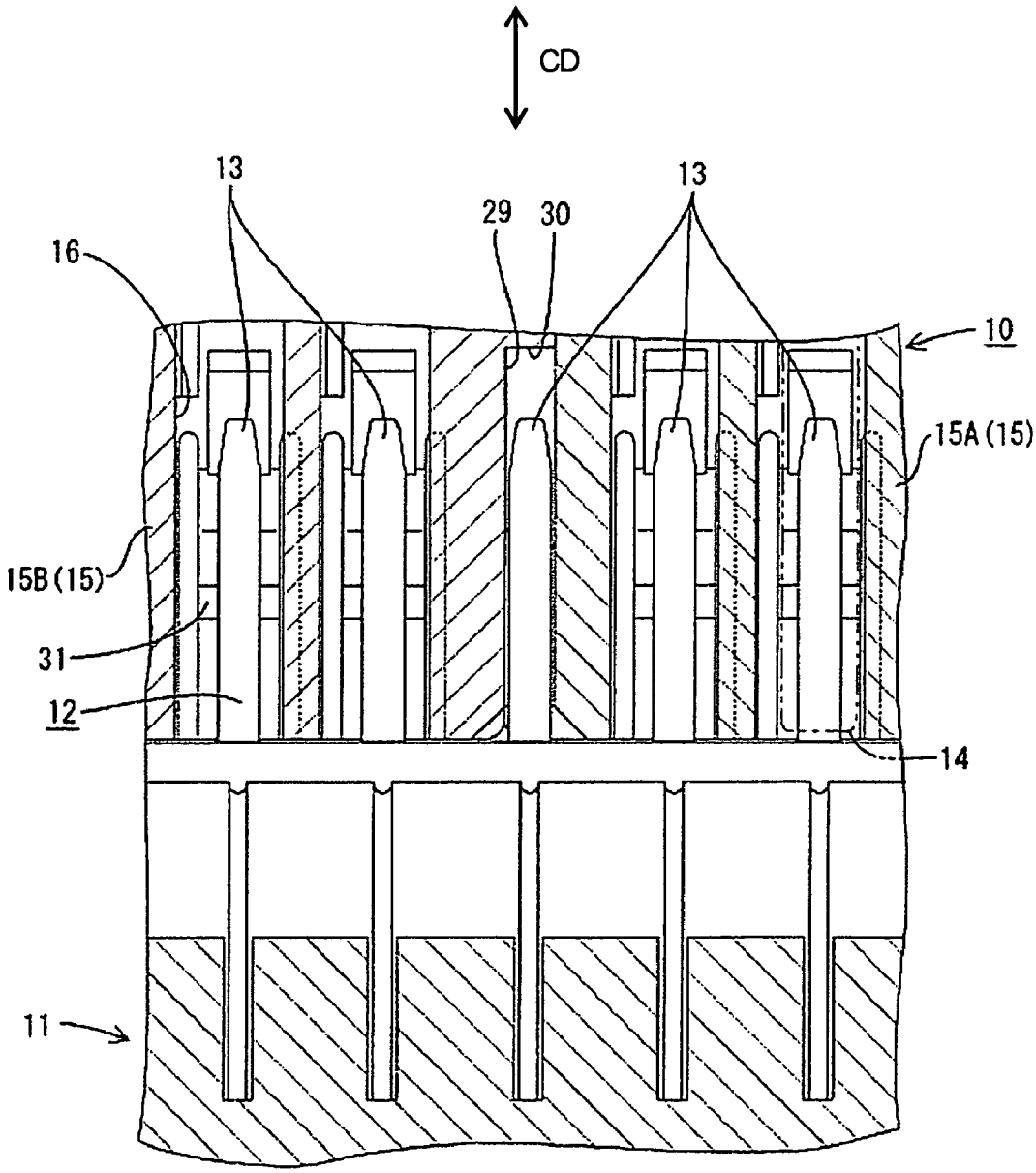
FIG. 11 is a partial enlarged section showing a state after the male housing and the female housing are connected.

The male housing 11 is made e.g. of synthetic resin and at least one busbar member 12 preferably formed by press-forming or cutting a conductive metal sheet into a specified shape and bending, embossing and/or folding the resulting the conductive (metal) sheet is arranged therein (see FIG. 10). This busbar member 12 is formed with one or more, preferably with a plurality of male tabs 13 projecting substantially forward with respect to the connecting direction CD of the male housing 11, and these male tabs 13 preferably are provided for shorting two or more female terminal fittings 14 by being connected with the female terminal fittings 14 to be described later.

Figure 1:
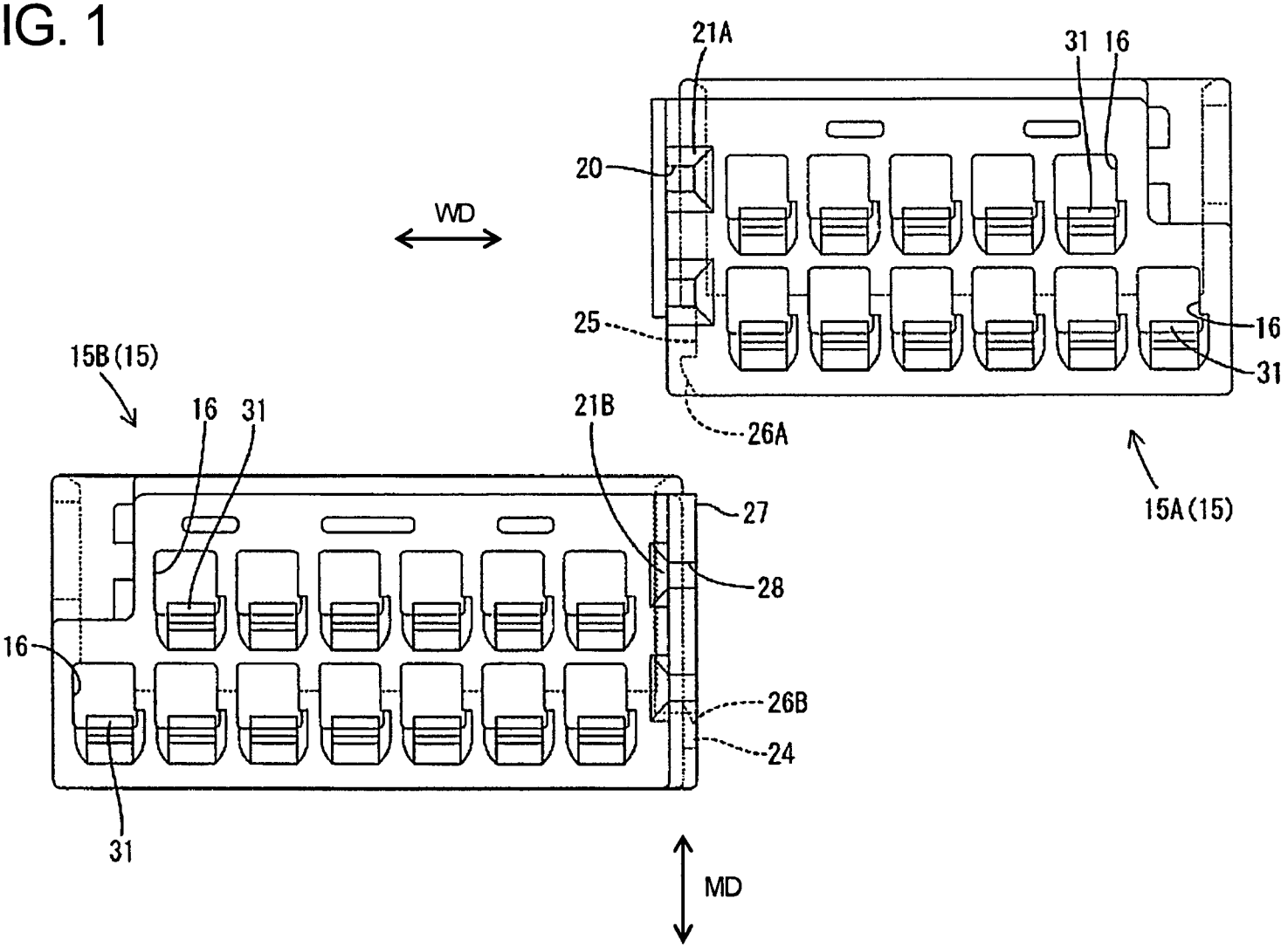
FIG. 1 is a front view showing a state before a first and a second blocks constituting a female housing of a connector according to one embodiment of the invention are united.
Figure 2:
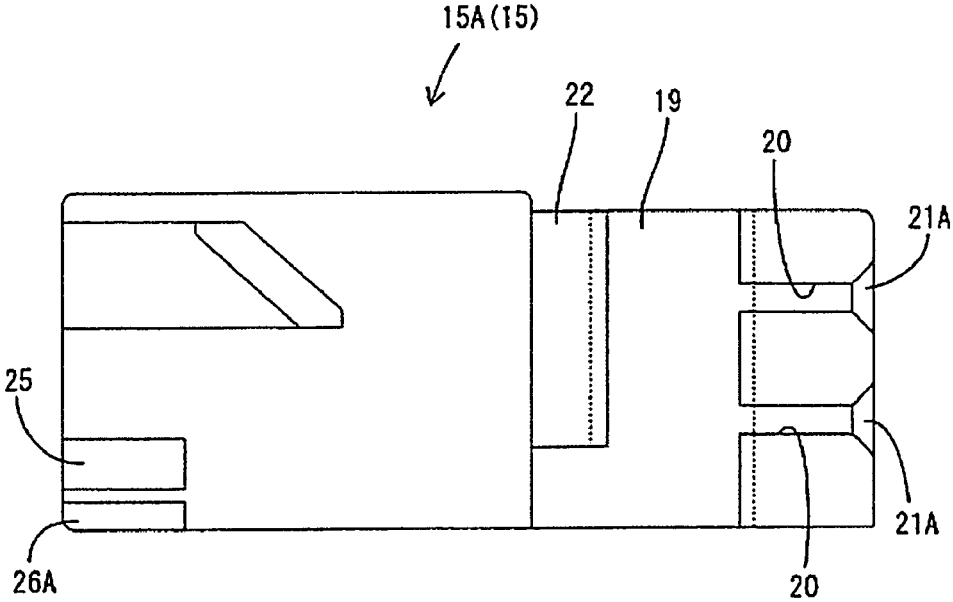
FIG. 2 is a side view of the first block.
Figure 3:
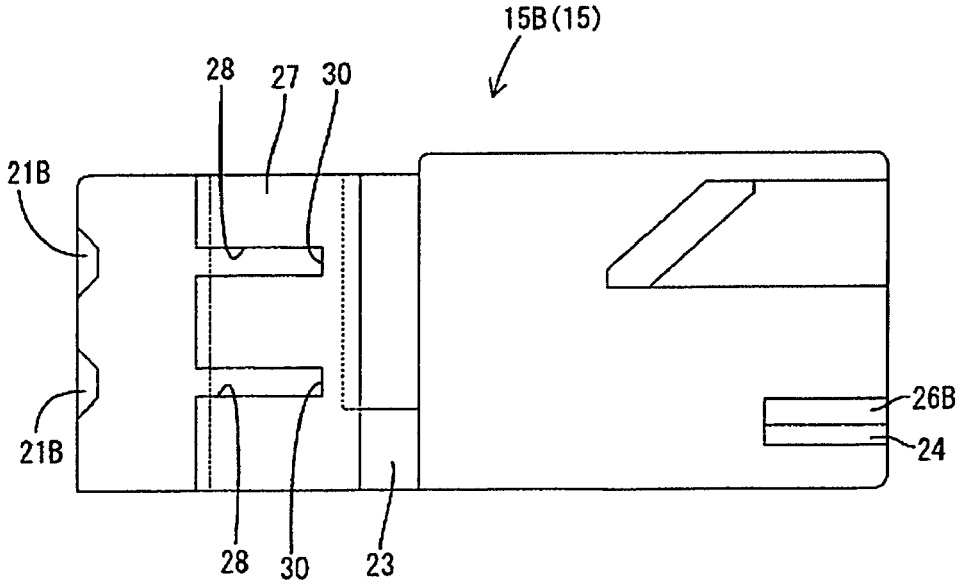
FIG. 3 is a side view of the second block.

The female housing 10 is made e.g. of synthetic resin as a divided housing with first and second blocks 15A and 15B arranged transversely in FIG. 1 along a width direction WD that is normal to a connecting direction CD of the female housing 10. The blocks 15A, 15B can be united together. With reference to FIG. 1, the left surface of the first block 15A and the right surface of the second block 15B define boundary surfaces between the two blocks 15A, 15B. Cavities 16 penetrate the blocks 15A, 15B in forward and backward directions penetrating the plane of FIG. 1 and substantially along the connecting direction CD of the female housing 10. The cavities 16 are arranged substantially side by side along the width direction WD and along the vertical direction in FIG. 1 at two stages. Female terminal fittings 14 are inserted into these cavities 16. A resiliently deformable lock 31 projects from an inner wall of each cavity 16 for locking the female terminal fitting 14. A retainer insertion hole 17 is formed at a rear side of the upper surface of each block 15A, 15B with respect to the connecting direction CD of the female housing 10 and has a depth to communicate with the respective cavities 16. A retainer 18 is inserted into the retainer insertion hole 17 to lock the female terminal fittings 14 doubly in cooperation with the locks 31 (see FIGS. 5 and 9).

A dovetail groove 19 is formed near the front of the left surface of the first block 15A in FIG. 1 and extends substantially vertically along a mating direction MD that is substantially normal to the connecting direction CD of the female housing 10. Groove-side tab insertion passages 20 are arranged one above the other in the left surface of the first block 15A. The groove-side tab insertion passages 20 extend back along the connecting direction CD from the front surface of the first block 15A to the dovetail groove 19. Tapered surfaces 21A are formed at the front openings of the tab insertion passages 20 for guiding the insertion of the male tabs 13 therein. A rear wall 22 defines the rear of the dovetail groove 19 and is cut off from the bottom end of the first block 15A to a specified height position. The rear wall 22 contacts a contact wall 23 of the second block 15B, as described later.

An engaging-projection receiving recess 25 is formed near the bottom rear of the left surface of the first block 15A and is engageable with an engaging projection 24. A tapered surface 26A is formed on the left surface of the first block 15A below the engaging-projection receiving recess 25 and inclines out toward the top from the bottom edge so that the engaging projection 24 can easily move to the recess 25.

Figure 4:
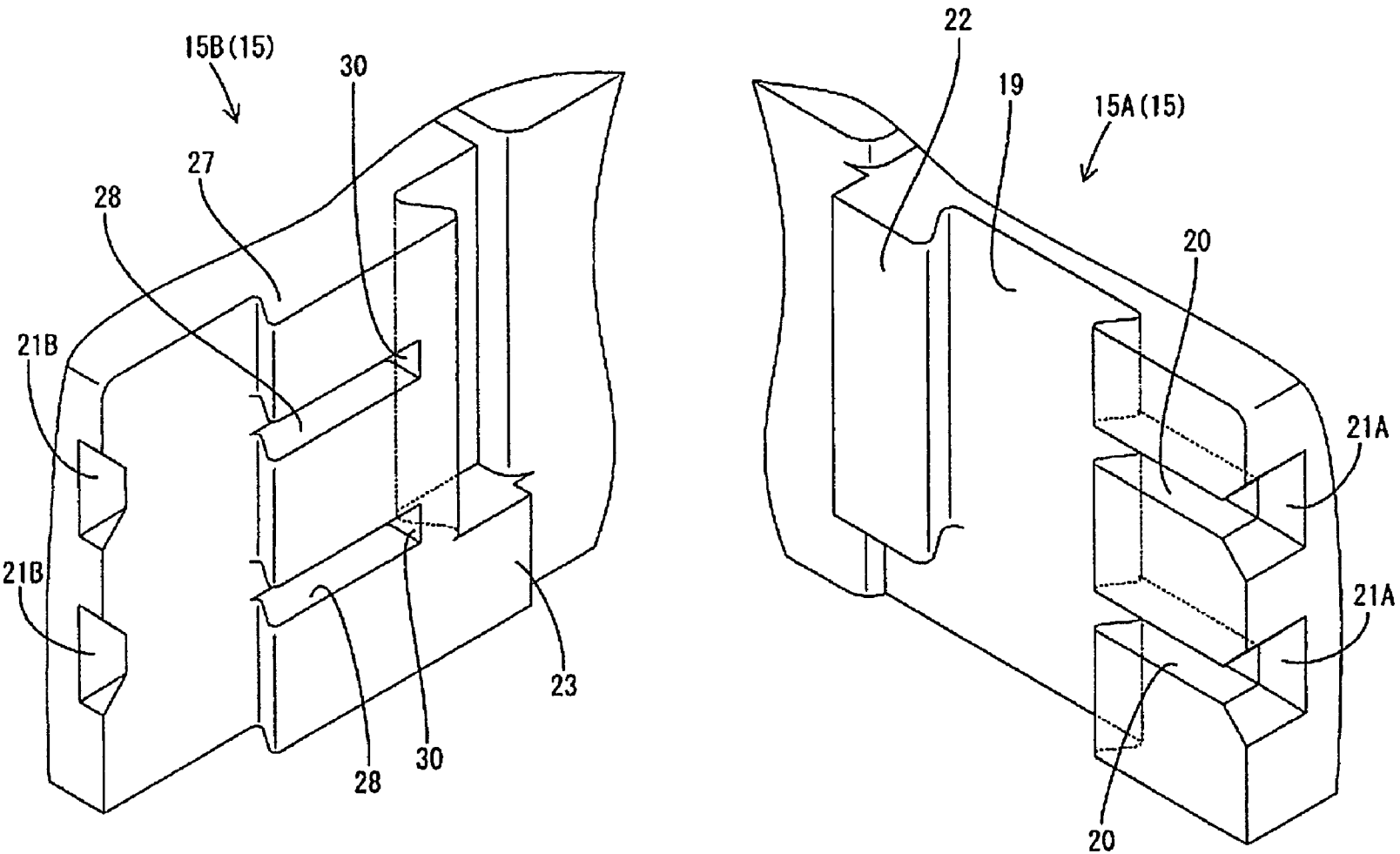
FIG. 4 is a partial enlarged perspective view of the first and second blocks.
Figure 5:
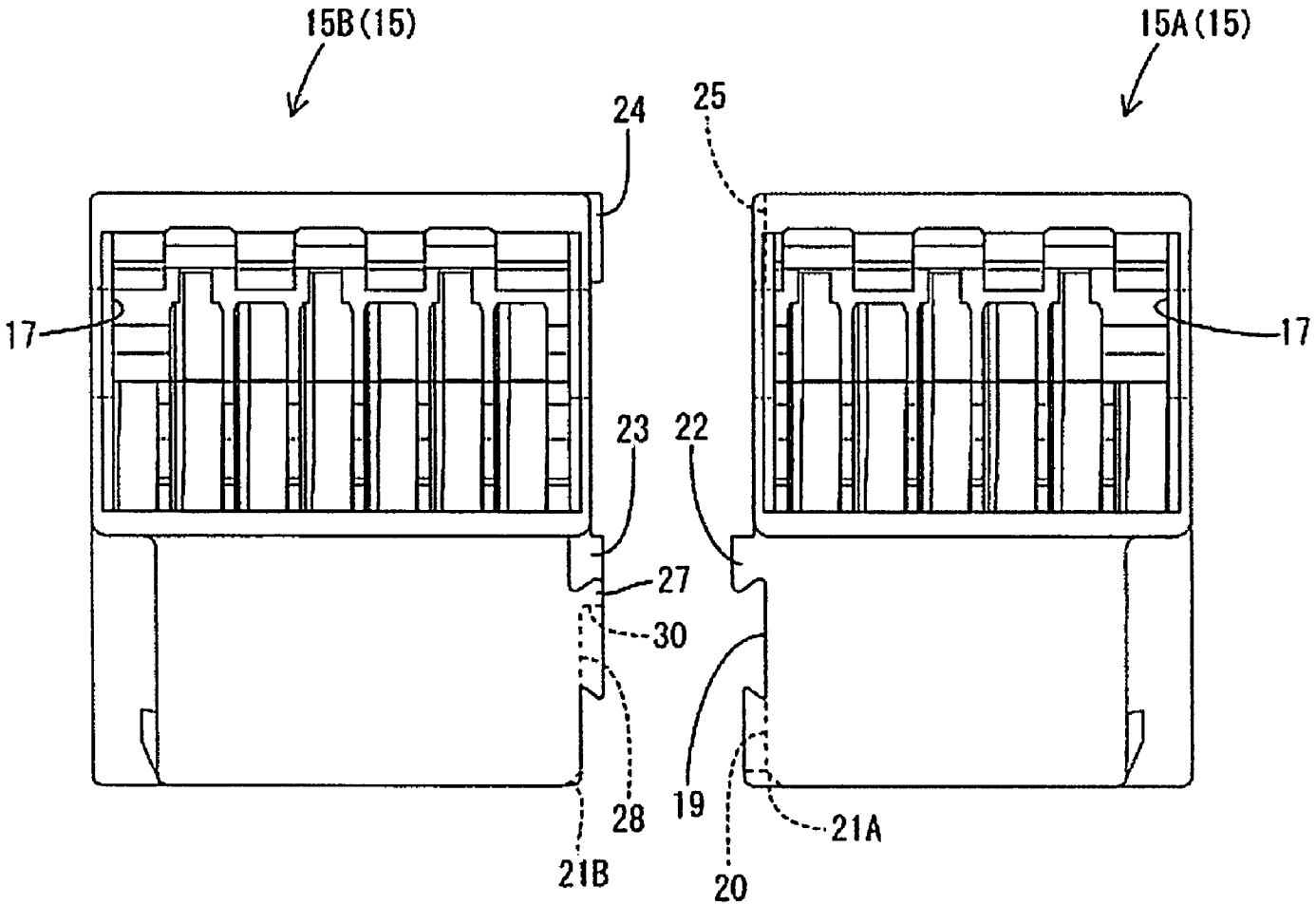
FIG. 5 is a plan view showing a state before the first and second blocks are united.

A rib 27 is formed near the front of the right surface of the second block 15B and extends vertically in a position for engaging the dovetail groove 19 (see FIG. 4). Rib-side tab insertion passages 28 are formed one above the other in the rib 27 and extend forward and backward substantially along the connecting direction CD for receiving the male tabs 13. Back walls 30 of the rib side tab insertion passages 28 are set so as not to interfere with the leading ends of the male tabs 13 when the two housings 10, 11 are connected properly with the two blocks 15A, 15B united properly. The contact wall 23 projects back from the bottom end of the rib 27. Thus, the bottom surface of the rear wall 22 of the first block 15A contacts the upper surface of the contact wall 23 from above to prevent further downward displacement of the first block 15A along the mating direction MD. Tapered surfaces 21B are formed at the front edge of the right surface of the second block 15B and correspond to the dovetail-groove side tab insertion passages 20 of the first block 15A.

The engaging projection 24 projects near the rear end of the right surface of the second block 15B at a position corresponding to the engaging-projection receiving recess 25 of the first block 15A. A tapered surface 26B is formed on the upper surface of the engaging projection 24 so that the engaging projection 24 can move easily over the wall below the engaging-projection receiving recess 25. The bottom end surface of the engaging projection 24 is perpendicular to the right surface of the second block 15B, and an upward displacement along the mating direction MD of the first block 15A is prevented by the contact of the bottom end surface of the engaging projection 24 with the bottom end surface of the engaging-projection receiving recess 25 from above.

The first and second blocks 15A and 15B can be united substantially along the mating direction MD by sliding the first block 15A relative to the second block 15B from above to fit the rib 27 into the dovetail groove 19. The bottom surface of the rear wall 22 of the first block 15A contacts the upper surface of the contact wall 23 of the second block 15B from above when the first and second blocks 15A, 15B are united at the proper positions to prevent downward displacement of the first block 15A. Additionally, the bottom end surface of the engaging projection 24 of the second block 15B contacts the bottom surface of the engaging-projection receiving recess 25 of the first block 15A from above to prevent upward displacement of the first block 15A. In this way, the first and second blocks 15A, 15B are positioned vertically along the mating direction MD. Displacements of the first and second blocks 15A, 15B forward and backward along the connecting direction CD and the width direction WD are prevented by the engagement of the rib 27 of the second block 15B with the vertically extending dovetail groove 19 in the first block 15A. In other words, the mating direction MD is substantially normal to the forward and backward directions, connecting direction CD) and the width direction WD.

Figure 6:
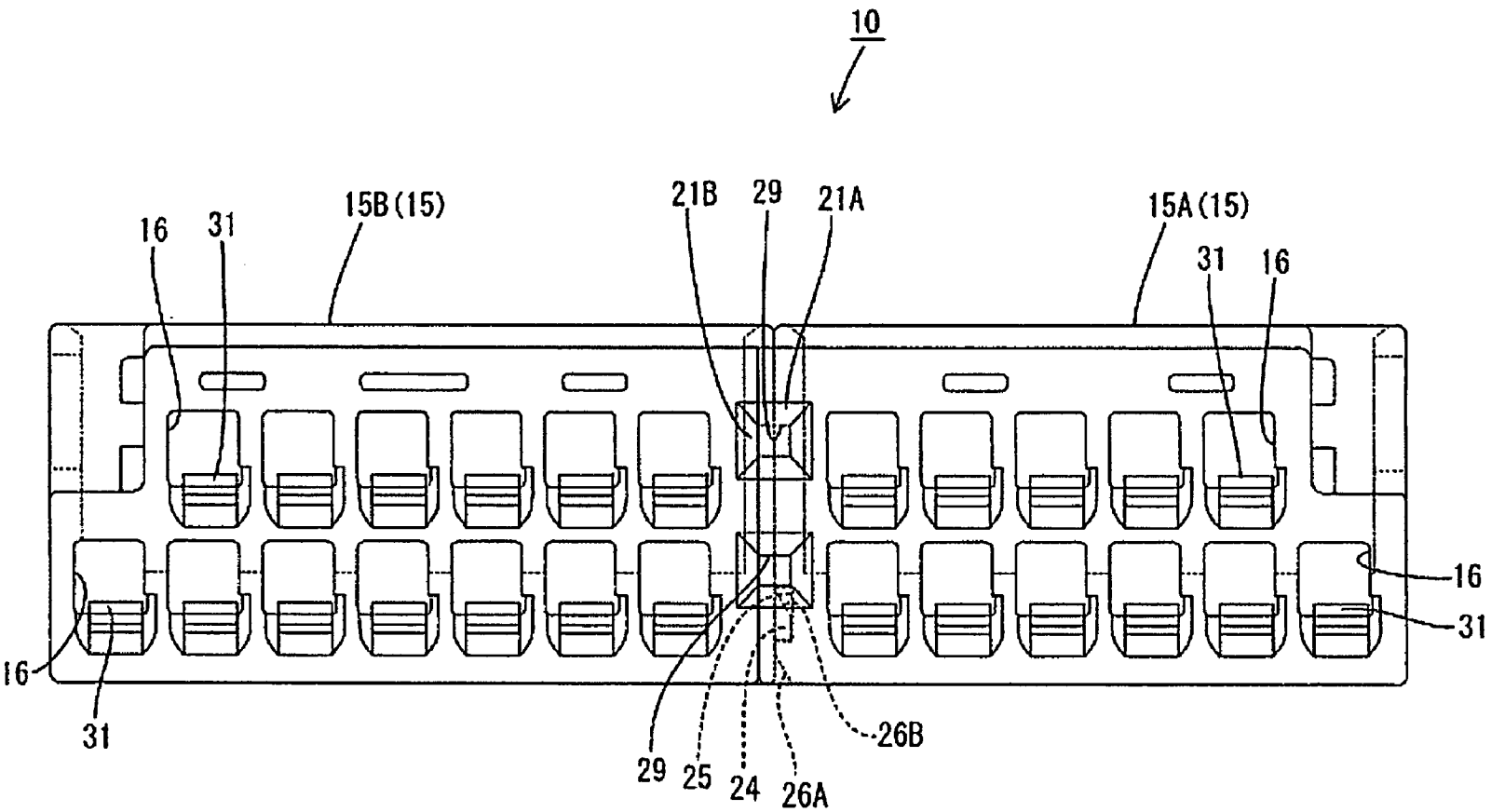
FIG. 6 is a front view showing a state where the first and second blocks are united.
Figure 7:
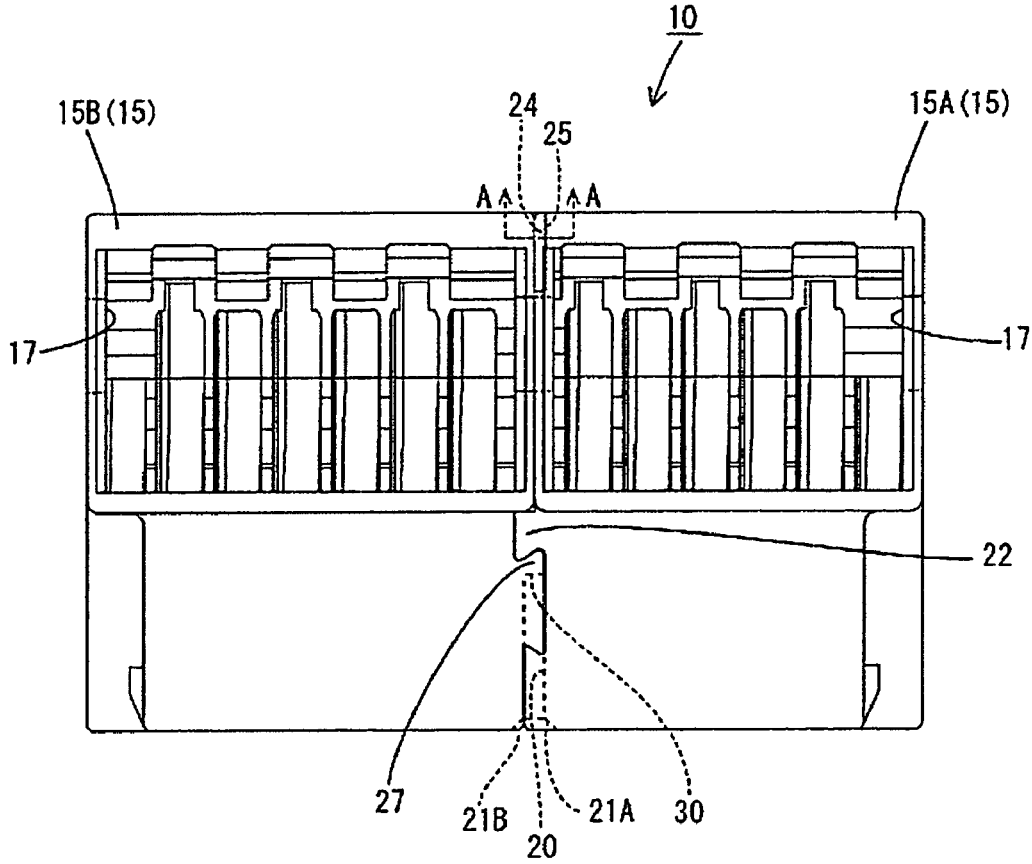
FIG. 7 is a plan view showing the state where the first and second blocks are united.
Figure 8:
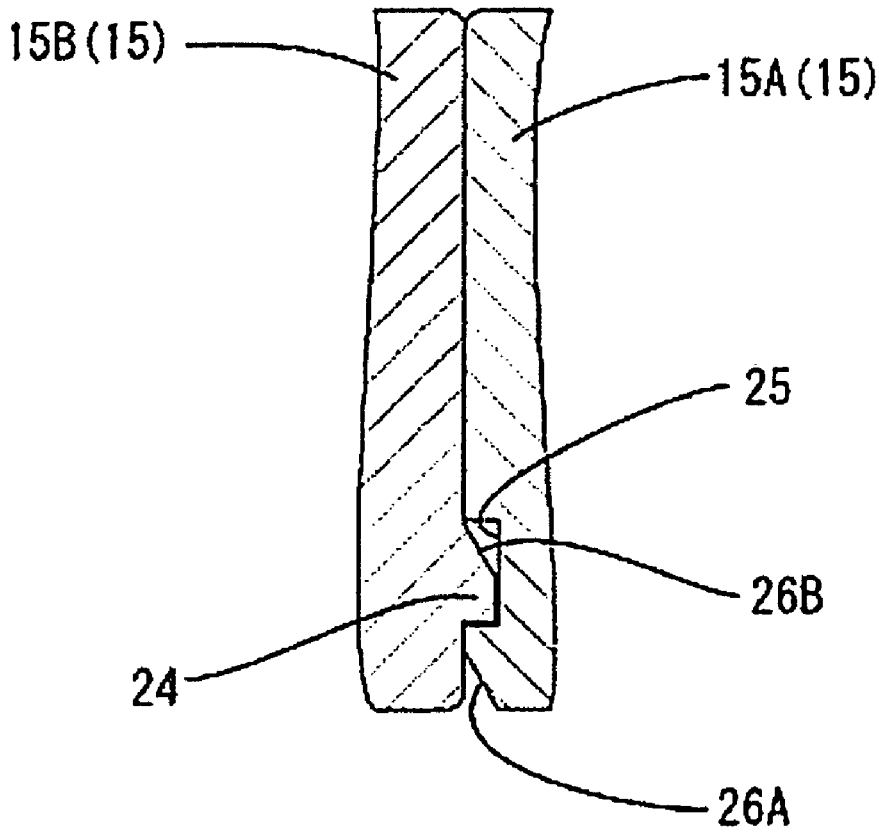
FIG. 8 is a section along A-A of FIG. 7.
Figure 9:
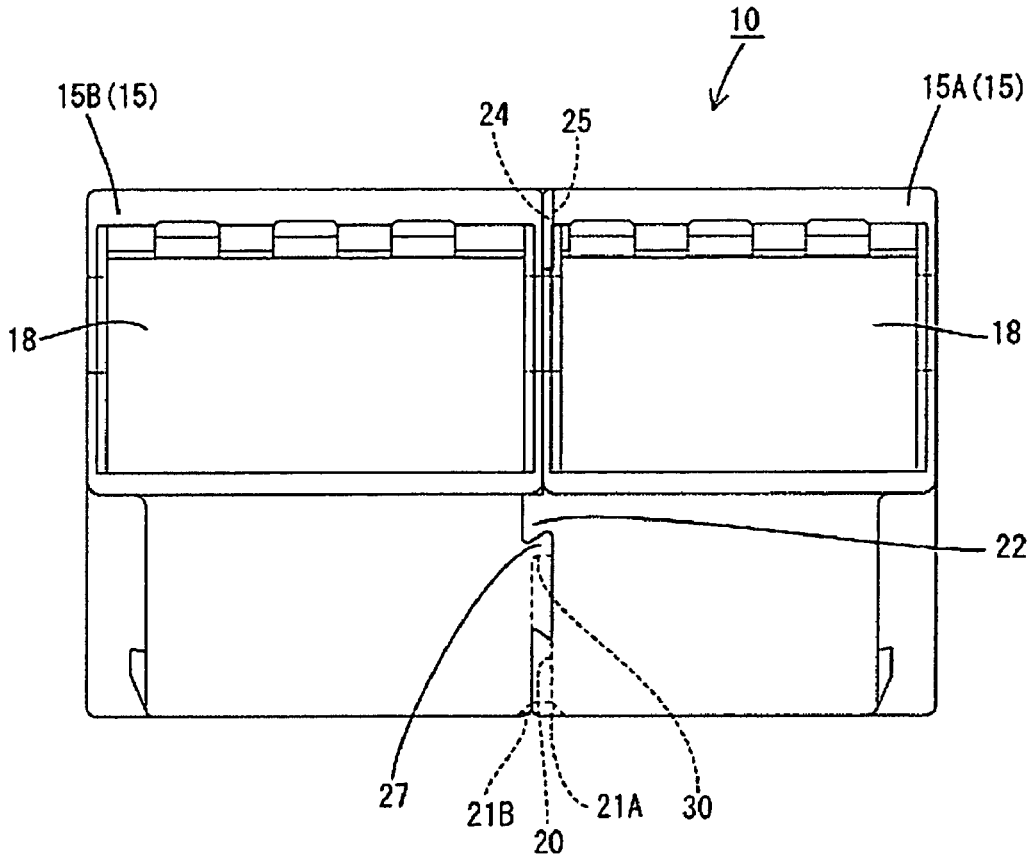
FIG. 9 is a plan view showing a state where a retainer is mounted in the female housing.

The groove-side tab insertion passages 20 in the first block 15A and the rib-side tab insertion passages 28 in the second block 15B communicate with each other when the first and second blocks 15A, 15B are united at the proper positions to form the female housing 10. Thus, tab-shaped terminal insertion passages 29 extend back from the connecting surface of the female housing 10 with the male housing 11 to the dovetail groove 19 and the rib 27 substantially along the boundary surfaces of the first and second blocks 15A, 15B. The engagement of the engaging projection 24 and engaging-projection receiving recess 25 aligns the groove-side tab insertion passages 20 and the rib-side tab insertion passages 28. As shown in FIG. 6, the cavities 16 in the first and second blocks 15A, 15B are arrayed in rows along the width direction WD when the first and second blocks 15A, 15B are united at the proper positions. In this state, the tab insertion passages 29 are aligned vertically with each other and are aligned with the rows of the cavities at the upper and lower stages along width direction WD.

Figure 12:
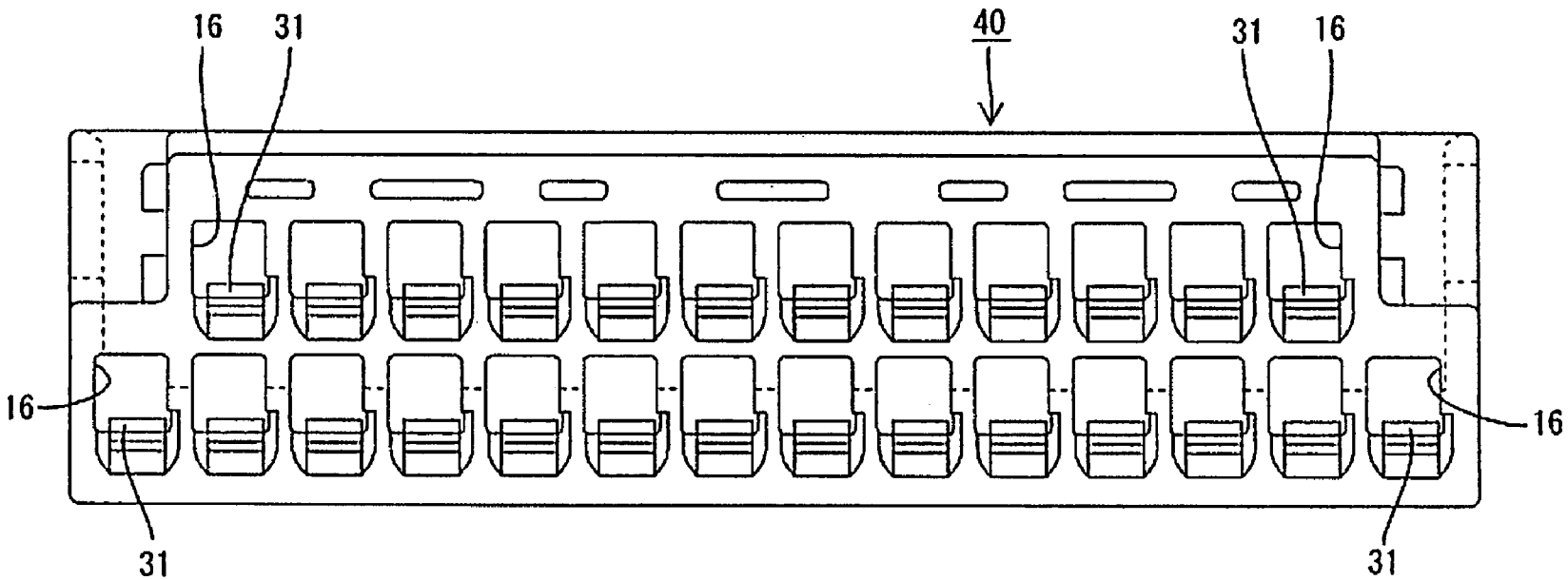
FIG. 12 is a plan view of a unitary-type female housing.

The male housing 11 is connectable with the divided female housing 10 formed by uniting the first and second blocks 15A, 15B and also is connectable with a unitary female housing 40. FIG. 12 shows the unitary female housing 40 for comparison with the divided female housing 10. The unitary female housing 40 is made e.g. of synthetic resin, and has cavities 16 for accommodating the female terminal fittings 14. The cavities 16 penetrate the female housing 40 in forward and backward directions and are arranged side by side along the width direction WD and at two stages.

The male tabs 13 enter the cavities 16 when the male housing 11 is connected properly with the unitary female housing 40.

On the other hand, the male tabs 13 at positions corresponding to the cavities 16 enter the cavities 16 and contact the female terminal fittings 14 for electrical connection when the male housing 11 and the divided female housing 10 are connected. The tabs 13 arranged at positions corresponding to the tab insertion passages 29 enter the tab insertion passages 29. The back walls 30 of the tab insertion passages 29 are formed to avoid interference with the leading ends of the male tabs 13 when the two housings 10, 20 are connected properly. The tab insertion passages 29 are formed in the divided female housing 10 at the positions corresponding to specified cavities (e.g. the seventh cavity at the upper stage from left in FIG. 1 and the eighth cavity at the lower stage from left in FIG. 1) of the unitary female housing 40.

The female housing 10 is assembled by placing the first block 15A up and to the right of the second block 15B, as shown in FIG. 1. The first housing 15A then is slid down to bring the left surface of the first block 15A and the corresponding right surface of the second block 15B into sliding contact. As a result, the rib 27 of the second block 15B enters the dovetail groove 19 of the first block 15A. Sufficient sliding movement of the first block 15A down along the mating direction MD causes the engaging projection 24 of the second block 15B to contact the bottom edge of the right surface of the first block 15A from below. The engaging projection 24 and the tapered surface 26B of the second block 15B then slide in contact with the tapered surface 26A at the bottom of the left surface of the first block 15A. Thus, the engaging projection 24 moves onto the left surface of the first block 15A. The engaging projection 24 fits into the engaging-projection receiving recess 25 when the first block 15A is pushed further down along the mating direction MD. The bottom end surface of the engaging projection 24 then contacts the bottom surface of the engaging-projection receiving recess 25 from above to prevent an upward displacement of the first block 15A. Further, the bottom surface of the rear wall 22 of the first block 15A contacts the upper surface of the contact wall 23 of the second block 15B from above to prevent a downward displacement of the first block 15A. The interengaged rib 27 and dovetail groove 19 extend vertically along the mating direction MD and prevent displacements of the first and second blocks 15A, 15B forward and backward along the connecting direction CD and along the width direction WD. In this way, the first and second blocks 15A, 15B are assembled to form the divided-type female housing 10.

The cavities 16 for the insertion of the female terminal fittings 14 typically should not be formed in the area of the female housing 10 where the dovetail groove 19 and the rib 27 are formed. Thus, male tabs 13 corresponding to the area where the dovetail groove 19 and the rib 27 are formed may strike against the front surface of the female housing 10, making it impossible to connect the two housings 10, 11. The male tabs 13 may not be provided at positions corresponding to the area where the dovetail groove 19 and the rib 27 are formed. However, with such a construction, the male housing 11 is used exclusively for the divided female housing 10 and cannot be used commonly for the unitary female housing 40.

In contrast, the female housing 10 of this embodiment, has tab insertion passages 29 formed in the boundary surfaces of the first and second blocks 15A, 15B and extending back from the connecting surface with the male housing 11 to the dovetail groove 19 and the rib 27. Thus, the male tabs 13 arranged at positions corresponding to the cavities 16 enter the cavities 16 and connect with the female terminal fittings 14, whereas those arranged at the positions corresponding to the dovetail groove 19 and the rib 27 enter the tab insertion passages 29 and do not interfere with the female housing 10. As a result, the male tabs 13 can be formed at the positions corresponding to the area of the divided-type female housing 10 where the dovetail groove 19 and the rib 27 are formed, and the male housing 11 can be used commonly for both the unitary female housing 40 and the divided female housing 10 without a risk of damaging the male tabs 13. With the divided female housing 10 and the male housing 11 properly connected, the male tabs 13 are guided by the tapered surfaces 21A, 21B formed at the opening edges of the tab-shaped terminal insertion passages 29.

The groove-side tab insertion passages 20 and the rib side tab insertion passages 28 will not align if the blocks 15A, 15B are united while being displaced relative to each other. As a result, parts of the inner walls of the tab insertion passages 29 may project in and may interfere with the male tabs 13 if an attempt is made to connect the housings 10, 11 in such a case. However, the engaging-projection receiving recess 25 is formed in the first block 15A and the engaging projection 24 is formed on the second block 15B. Thus, the groove-side tab insertion passages 20 and the rib side tab insertion passages 28 align when the blocks 15A, 15B are united, and the inner walls of the tab insertion passages 29 will not interfere with the male tabs 13.

Further, the dovetail groove 19 extends in the mating direction MD and substantially normal to the connecting direction CD of the female housing 10. Thus, the united blocks 15A, 15B cannot displace relative to each other along the connecting direction CD of the female housing 10. Accordingly, displacements of the blocks 15A, 15B along the connecting direction CD of the female housing 10 can be prevented even if the male housing 11 contacts the female housing 10 from the front with respect to the connecting direction CD upon connecting the two housings 10, 11.

The invention is not limited to the above described and illustrated embodiment. For example, the following embodiments are also embraced by the technical scope of the present invention as defined by the claims.

The blocks 15A, 15B are united by being slid vertically along the mating direction MD relative to each other in the foregoing embodiment. However, the invention is not limited thereto. The dovetail groove 19 and the rib 27 may extend in the width direction WD and the blocks 15A, 15B may be united by being slid relative to each other in the width direction WD. The blocks 15A, 15B can be united by being slid in any arbitrary mating direction MD at an angle to the connecting direction CD of the male and female housings 11, 10.

If the respective blocks 15A, 15B are constructed to include an engaging portion or an interacting portion so as not to displace in forward and backward directions, the dovetail groove 19 and the rib 27 may be formed to extend in forward and backward directions and the blocks 15A, 15B may be united by being slid in forward and backward directions. Alternatively, each of the blocks 15A and 15B may be formed with one or more dovetail grooves 19 and one or more ribs 27 that are engageable with each other, respectively.

The engaging portion comprises the dovetail groove 19 and the interacting portion is the rib 27 in the foregoing embodiment. However, the engaging portion may be or comprise a locking claw and the interacting portion may be a receiving portion resiliently engageable with the locking claw.

The busbar 12 including the male tabs 13 is arranged in the male housing 11 in the foregoing embodiment. However, the invention is not limited thereto and male terminal fittings including the male tabs 13 may be arranged.

Although the female housing 10 is divided into two blocks 15 in the foregoing embodiment, the female housing 10 may be divided into three or more blocks 15.

The female housing 10 may be divided into three or more blocks 15. In these embodiments, each block 15 to be located between other blocks 15 may have at least one dovetail groove 19 formed in one boundary surface and at lest one rib 27 on the other boundary surface, and these blocks 15 are arranged side by side between two end blocks. Alternatively, each such block 15 may have at least one dovetail groove 19 formed in both boundary surfaces or at least one rib 27 on both boundary surfaces, and the blocks 15 having the dovetail grooves 19 in both boundary surfaces and those having the ribs 27 on both boundary surfaces are arranged alternately between two end blocks.

What is claimed is:

1. A connector, comprising a housing formed from blocks, said blocks having engaging portions for uniting the blocks along a direction intersecting the connecting direction, the blocks being formed with cavities for accommodating terminal fittings and being connectable with a mating housing along a connecting direction while the blocks are united, wherein:

at least one tab insertion passage extending back substantially in the connecting direction from a connecting surface of the housing with the mating housing substantially to the engaging portion along boundary surfaces of the respective blocks while the blocks are united, and a tab-shaped terminal of the mating housing being insertable into the tab insertion passage without interference when the housing is connected properly with the mating connector housing.

2. The connector of claim 1, wherein at least one of the engaging portions comprises a dovetail groove extending in a direction at an angle to the connecting direction, and at least another of the engaging portions comprises a rib fittable into the dovetail groove.

3. The connector of claim 2, wherein, at least one groove-side tab insertion passage is formed in at least one of the blocks to communicate with the respective dovetail groove and at least one rib-side tab insertion passage is formed in another of the blocks.

4. The connector of claim 3, wherein the groove-side tab insertion passage and the rib-side tab insertion passage communicate with each other to form at least part of the tab insertion passage by uniting the respective blocks.

5. The connector of claim 4, wherein the blocks are formed with positioning portions for aligning the dovetail-groove side tab insertion passage and the rib side tab insertion passage while being united.

6. The connector of claim 2, wherein the blocks can be united substantially along the mating direction by sliding one of said blocks relative to another of said blocks to fit the ribs into the dovetail grooves.

7. The connector of claim 1, wherein one of the engaging portions comprises a locking claw and another of the engaging portions comprises a receiving portion resiliently engageable with the locking claw.

8. A connector assembly, comprising the housing of claim 1 and a mating housing, terminal fittings in the housing, and tab-shaped terminals disposed in the mating housing to be connected with the terminal fittings.

9. A connector, comprising:

a first block having a connecting surface for mating with a mating housing and at least one cavity extending rearward along a connecting direction from the connecting surface for receiving a first terminal fitting, a dovetail groove formed on a side surface of the first block and extending along a mounting direction at an angle to the connection direction direction;

a second block having a connecting surface for mating with the mating housing and at least one cavity extending rearward along the connecting direction from the connecting surface for receiving a second terminal fitting, a dovetail rib formed on a side surface of the second block and extending along the mounting direction at an angle to the connecting direction, the dovetail groove being engageable with the dovetail rib to hold the blocks in a united condition; and at least one tab insertion passage extending back substantially in the connecting direction from the connecting surface of the first block and passing through portions of the first block defining the dovetail groove and through at least part of the dovetail rib of the second block, whereby the tab insertion passage is disposed and dimensioned for receiving a tab-shaped terminal of the mating housing.

10. The connector of claim 9, wherein the blocks are formed with positioning portions for aligning portions of the tab insertion passage on the first block with portions of the tab insertion passage on the second block.

11. A connector assembly, comprising:

a male housing with male tabs mounted therein;

a unitary female housing configured for connection with the male housing, the unitary female housing being formed with cavities and female terminal fittings being mounted in the cavities, the cavities being disposed so that the male tabs enter the cavities and connect with the female terminal fittings when the unitary female housing is connected with the male housing; and a divided female housing having first and second blocks, a dovetail groove on a side surface of the first block engaged with a dovetail rib on a side surface of the second block for uniting the first and second blocks, cavities formed in the first and second blocks and female terminal fittings being mounted in the cavities, the cavities in the first and second blocks being disposed for receiving a plurality of the male tabs when the divided female housing is connected with the male housing so that the female terminal fittings therein connect respectively with the male tabs, at least one tab insertion passage passing through portions of the first block defining the dovetail groove and through at least part of the dovetail rib of the second block, whereby the at least one tab insertion passage is disposed and dimensioned for receiving at least one of the male tabs of the male housing so that all of the male tabs are accommodated when either the unitary female housing or the divided female housing is connected with the male housing.

* * * * *